US005549797A

United States Patent [19]

Hashimoto et al.

[11] Patent Number: 5,549,797

[45] Date of Patent: Aug. 27, 1996

[54] HIGHLY CORROSION-RESISTANT AMORPHOUS ALLOYS

[75] Inventors: Koji Hashimoto, Sendai; Hideaki Yoshioka, Kurobe; Asahi Kawashima, Sendai, all of Japan

[73] Assignees: Koji Hashimoto, Sendai; YKK Corporation, Tokyo, both of Japan

[21] Appl. No.: 207,891

[22] Filed: Mar. 7, 1994

Related U.S. Application Data

[62] Division of Ser. No. 73,623, Jun. 7, 1993, abandoned, which is a continuation of Ser. No. 878,567, May 5, 1992, abandoned.

[30] Foreign Application Priority Data

May 15, 1991 [JP] Japan ..... 3-138575

[51] Int. Cl.[6] ..... C23C 14/34

[52] U.S. Cl. ..... 204/192.11; 148/403; 420/421; 420/422; 420/588

[58] Field of Search ..... 204/192.1, 192.15, 204/192.16; 148/403, 304; 420/421, 422, 588

[56] References Cited

U.S. PATENT DOCUMENTS

| | | | |
|---|---|---|---|
| 4,225,339 | 9/1980 | Inomata et al. | 148/403 |
| 4,231,816 | 11/1980 | Cuomo et al. | 204/192.15 |
| 4,496,635 | 1/1985 | Wang et al. | 428/680 |
| 4,728,580 | 3/1988 | Grasselli et al. | 148/403 |
| 4,797,166 | 1/1989 | Von Allen et al. | 148/403 |
| 4,963,240 | 10/1990 | Fukasawa et al. | 204/192.15 |
| 4,966,676 | 10/1990 | Fukasawa et al. | 204/298.12 |
| 4,968,363 | 11/1980 | Hashimoto et al. | 148/403 |

FOREIGN PATENT DOCUMENTS

| | | | |
|---|---|---|---|
| 58-153749 | 9/1983 | Japan | 148/403 |

*Primary Examiner*—John Sheehan

*Attorney, Agent, or Firm*—Flynn, Thiel, Boutell & Tanis, P.C.

[57] ABSTRACT

Amorphous alloy comprising 30 to 75 atomic % Cr, the remainder being substantially at least one element selected from the group consisting of Ti and Zr and alloys represented by the general formula: $X_aCr_bM_c$ wherein X is at least one element selected from the group consisting of Ti and Zr; M is at least one element selected from the group consisting of Mg, Al, Fe, Co, Ni, Cu, Mo and W; and a, b, and c are, in atomic percentage, $a>20$, $20 \leqq b \leqq 75$, $0<c \leqq 20$ and $a+b+c=100$. The alloys are excellent in corrosion resistance and wear resistance, form a stable protective film and are spontaneously passive, even in corrosive environment such as a poorly oxidizing, highly corrosive HCl solution containing chlorine ions.

13 Claims, 5 Drawing Sheets

HIGHLY CORROSION-RESISTANT AMORPHOUS ALLOYS

This application is a division of U.S. Ser. No. 08/073,623, filed Jun. 7, 1993, now abandoned, which is a continuation of U.S. Ser. No. 07/878,567, filed May 5, 1992 now abandoned.

BACKGROUND OF THE INVENTION

1. Field of the Invention

This invention relates to novel amorphous alloys which are equipped with excellent properties such as a high corrosion resistance and wear resistance and are usable in various industrial and civil fields and in chemical plants.

2. Description of the Prior Art

A variety of amorphous alloys have been reported in recent years, which can exhibit excellent corrosion resistance not available from crystalline alloys. Roughly dividing these amorphous alloys, they can be classified into two kinds, one being metal-semi-metal amorphous alloys and the other metal-metal amorphous alloys. The former are of the alloy systems that contain Cr as an element imparting corrosion resistance, one or more transition metals, such as Fe, Ni an Co, as principal elements, and 15 to 20 atomic % of a semi-metal, such as P or C, as an element for amorphyzing the alloys. The latter are alloys composed of one or more elements of IVa and Va groups of the periodic table as elements effective for corrosion resistance, such as Ti, Zr, Nb and/or Ta, in combination with Ni (VIII group) or Cu (Ib group).

As is apparent from these examples, the highly corrosion-resistant amorphous alloys reported to date require the addition of a semi-metal where Cr is contained. Where metal-metal alloys contain Ti, it has been possible to realize high corrosion resistance only by combinations of elements belonging to groups which are far apart from each other in the periodic table.

An object of the present invention is to provide alloys composed of Ti or Zr and Cr and alloys composed of the first-mentioned alloys with one or more additional elements represented by M (at least one element selected from the group consisting of Mg, Al, Fe, Co, Ni, Cu, Mo and W) not as chemically heterogeneous crystalline alloys but as homogeneous amorphous alloys having high corrosion resistance and high wear resistance.

An alloy is generally crystalline in a solid state. When the composition of an alloy is limited and a method which does not develop long-range regularity in the atomic arrangement is applied in the course of formation of a solid, for example, the alloy is subjected to superquench solidification from a molten state, an amorphous structure having no crystalline structure and resembling a liquid is obtained. Such an alloy is called an "amorphous alloy". An amorphous alloy is homogeneous single-phase alloy in the form of a supersaturated solid solution in many instance, has substantially higher strength than the conventionally used metals and, depending on its composition, exhibits various properties led by extraordinarily high corrosion resistance.

The present inventors have proceeded with extensive research on the properties,of amorphous alloys not reported before. As a result, it has already been found that one or more elements of IVa and/or Va groups, such as Ti, Zr, Ta and/or Nb, can be combined with Al or Cu into an amorphous alloy by using sputtering techniques, which does not require melting, in the course of the formation of the alloy and the resulting alloy has excellent corrosion resistance. Some of these alloys have already been proposed in Japanese Patent Application Nos. 63-51567, 63-51568 and 63-260020. Japanese Patent Application No. 63-260020 is directed to the following two inventive aspects.

(1) A highly corrosion-resistant amorphous aluminum alloy comprising 25 to 60 atomic % Ti, the remainder being substantially Al.

(2) A highly corrosion-resistant amorphous aluminum alloy comprising 25 to 60 atomic %, in total, of one or more of Mo, W, Ta and Nb and Ti, the content of one more of Mo, W, Ta and Nb being not more than 5 atomic %, the remainder being substantially Al.

It has also already been found that Al can also form an amorphous alloy together with Zr by using a sputtering technique, that an Al alloy containing Zr and Ti can be obtained as a homogeneous amorphous alloy, that an alloy containing Zr as a principal alloying element in combination with a high melting-point metal such as Mo, W, Ta or Nb can be prepared as an amorphous alloy, and that all of these alloys are highly corrosion-resistant amorphous alloys which can form a protective film which is stable even in a severe corrosive environment such as hydrochloric acid or a solution containing chlorine ions and can hence be spontaneously passive. Based on these findings, Japanese Patent Application No. 1-101768 was filed. Japanese Patent Application No. 1-101768 is directed to the following three inventive aspects.

(1) An amorphous aluminum alloy comprising 10 to 75 atomic % Zr, the remainder being substantially Al.

(2) A highly corrosion-resistant amorphous aluminum alloy comprising 10 to 75 atomic %, in total, of Zr and Ti, the content of Zr being not less than 5 atomic %, the remainder being substantially Al.

(3) A highly corrosion-resistant amorphous aluminum alloy comprising 10 to 75 atomic %, in total, of one or more of Mo, W, Ta and Nb and Zr, the content of one or more of Mo, W, Ta and Nb being less than 5 atomic %, the remainder being substantially Al.

The amorphous alloys described above are all composed of Al, which is inferior in corrosion resistance, and Ti and Zr, which both impart high corrosion resistance. Still better properties can be expected if an amorphous alloy comprising a combination of elements having excellent corrosion resistance can be provided.

Ti and Zr show excellent corrosion resistance in a neutral environment land also in an oxidative environment. Ti exhibits its effectiveness in improving pitting corrosion resistance, especially in an environment where chlorine ions are contained. On the other hand, Cr, when present in an amorphous state, is known to exhibit superb corrosion resistance, even in a poorly oxidizing environment such as hydrochloric acid. Success in the formation of an amorphous alloy, rather than a chemically heterogeneous crystalline alloy, from these elements having such excellent corrosion resistance is expected to assure a wide variety of utility as a new corrosion-resistant alloy suitable for numerous environments.

Ti or Zr and Cr, however, belong to IVa group and VIa group, respectively, and are hence close to each other in position. Their formation into an amorphous alloy has therefore been said to be difficult, even when a semi-metal is added, to say nothing of the metal-metal system. The object of this invention is therefore to overcome the above difficulty, thereby providing an amorphous alloy composed of Ti or Zr and Cr as well as an amorphous alloy composed of the first-mentioned amorphous alloying elements and one or more of various metallic elements added thereto.

SUMMARY OF THE INVENTION

With the forgoing in view, the present inventors have proceeded with research to investigate amorphous alloys composed of elements, both having excellent corrosion resistance. As a result, it has now been found that use of sputtering techniques makes it possible to form the above-mentioned amorphous alloy of Ti or Zr and Cr, known as corrosion resistance elements, and also that the amorphous phase forming range is broadened by the addition of not more than 20 atomic % of one or more of Mg, Al, Fe, Co, Ni, Cu, Mo and W to the alloy. It has also been found that all of these amorphous alloys are highly corrosion-resistant amorphous alloys which can form a protective film which is stable even in a corrosive environment containing hydrochloric acid or chlorine ions and can hence be spontaneously passive, leading to the completion of the present invention as set forth below.

(1) A highly corrosion-resistant amorphous alloy comprising 30 to 75 atomic % Cr, the remainder substantially comprising at least one element selected from the group consisting of Ti and Zr.

(2) A highly corrosion-resistant amorphous alloy represented by the following formula:

$$X_aCr_bM_c$$

wherein X is at least one element selected from the group consisting of Ti and Zr; M is at least one element selected from the group consisting of Mg, Al, Fe, Co, Ni, Cu, Mo and W; and a, b, and c are, in atomic percentage, $a>20$, $20\leqq b\leqq 75$, $0<c\leqq 20$ and $a+b+c=100$.

DETAILED DESCRIPTION OF THE PREFERRED EMBODIMENTS

Sputtering is one technique for forming an amorphous alloy. An amorphous alloy is formed by using a target prepared through sintering or casting, having the same average composition as the amorphous alloy to be prepared and formed, of plural crystalline phases instead of a single phase or by using a target with an element, which is to be alloyed, placed on or embedded in a metal plate made of a principal component of the amorphous alloy to be prepared.

Figure 1:
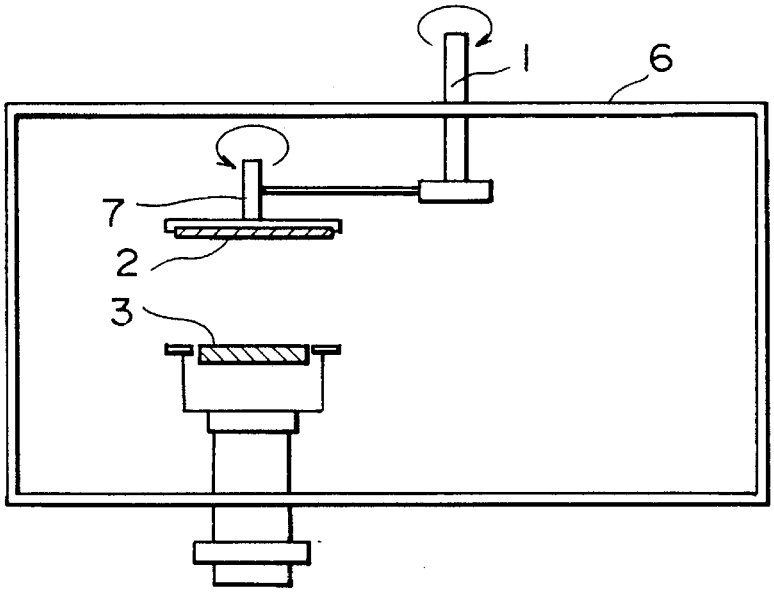
FIG. 1 is a schematic illustration showing one example of sputtering apparatus for producing an amorphous alloy of this invention.
Figure 2:
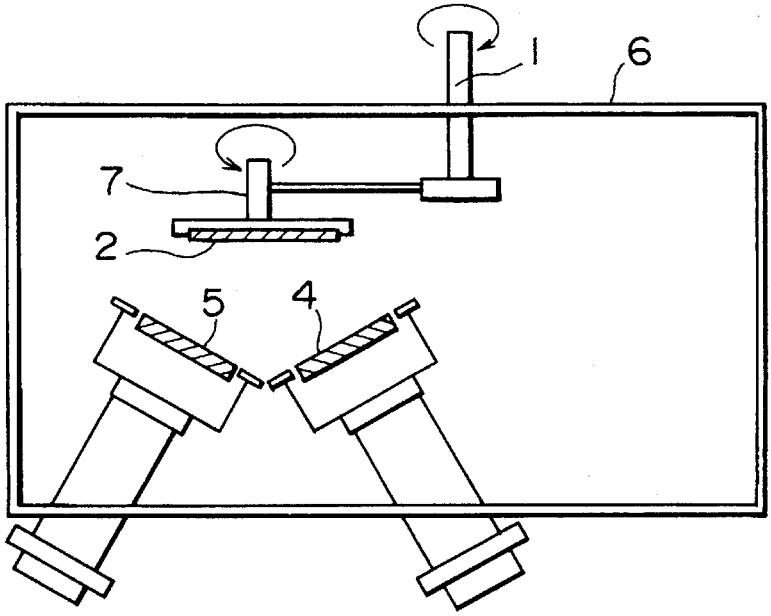
FIG. 2 is a schematic illustration showing another example of such a sputtering apparatus.

The present invention has been completed by either using or improving the above technique. By a sputtering technique using a target made of a Ti plate or Zr plate and Cr placed thereon or embedded therein, a target made of a Ti plate and Cr and Zr placed thereon or embedded therein or a target made of a Ti plate or Zr plate and Cr and at least one element represented by M (at least one element selected from the group consisting of Mg, Al, Fe, Co, Ni, Cu, Mo and W) placed thereon or embedded therein, an amorphous alloy of a predetermined composition can be obtained. To avoid any localized heterogeneity in the amorphous alloy so formed, it is desired, as shown in FIG. 1 by way of example, to rotate plural substrates 2 about a central shaft 1 in a sputtering chamber 6 and also to cause the substrates themselves to rotate about their axis 7. Further, to modify the composition of the resulting amorphous alloy in a wide range, it is possible, as depicted in FIG. 2 by way of example, to use as a target 4 a Ti plate with Cr embedded therein and as another target 5 a Zr plate with one or more metals, which are represented by M, embedded therein, to arrange the two targets aslant, to position the substrate 2 in the proximity of a crossing point of perpendicular lines from the two targets and then to sputter these two targets at the same time while controlling the outputs of their respective power supplies. Various, highly corrosion-resistant amorphous alloys as described above can also be obtained by combining various targets and methods, for example, by using as a target a sintered target with individual elements proportioned in advance to give a desired alloy composition.

An alloy having a composition as specified in the present invention, the alloy having been prepared by sputtering, is a single-phase, amorphous alloy in which the individual elements are evenly distributed to form a homogeneous solid solution. An extremely homogeneous protective film capable of assuring high corrosion resistance is formed on the amorphous alloy of the present,invention, that is, the homogeneous solid solution.

In a highly corrosive environment of poorly oxidizing hydrochloric acid or a solution containing chlorine ions, a crystalline alloy has the potential danger that, due to its heterogeneity, its passive film is often broken at an weak part to impair its corrosion resistance. To use an alloy in such an environment, the alloy should be imparted with the ability to uniformly form a stable protective film. This can be realized by the incorporation of an effective element in a necessary amount and, moreover, evenly in the alloy. In the case of a crystalline alloy, however, the addition of various alloying elements in large amounts often results in a multi-phase structure whose phases are different in chemical properties, thereby failing to realize tile desired corrosion resistance. As a matter of fact, chemical heterogeneity is rather disadvantageous for corrosion resistance.

In contrast, the amorphous alloy according to the present invention is a homogeneous solid solution and evenly contains effective elements, which can form a stable protective film, in prescribed amounts. A strong and homogeneous protective film is therefore formed on such an amorphous alloy, so that the alloy exhibits sufficiently high corrosion resistance.

A description will next be made of reasons for which the proportions of the individual components must be limited as specified in the present invention.

Cr is an element which can from an amorphous structure together with at least one of Ti and Zr. To form an amorphous structure by sputtering, it is necessary to contain Cr in an amount of 30 to 75 atomic % as specified in claim 1. When one or more of Mg, Al, Fe, Co, Ni, Cu, Mo and W, which are represented by M, is added as a third elements to the first inventive alloy, the upper limit of the content of the third element must be set at 20 atomic % as recited in the second inventive alloy because its content greater than 20 atomic % makes it impossible to form a homogeneous amorphous alloy. Further, the addition of the third element has been found to broaden the lower limit of the content of Cr, the content being capable of forming an amorphous alloy, from 30 atomic % specified in the first inventive alloy to 20 atomic %. Moreover, the corrosion resistance is not impaired by the addition of the third element insofar as the content of the third element remains below 20 atomic %. Ti and Zr can exist along with Cr and can form an amorphous structure. The content of one of Ti and Zr or the total amount of both Ti and Zr is required to be 25 atomic % or more in the first inventive alloy, whereas a content in excess of 20 atomic % is required in the second inventive alloy. Ti, Zr and Cr are elements each of which forms a protective film to exhibit corrosion resistance. The alloy according to the present invention is an amorphous alloy formed of a combination of these elements which are all excellent in corrosion resistance. It can, therefore, exhibit sufficient corrosion resistance in many corrosive environments, led by poorly oxidizing hydrochloric acid and including a solution containing chlorine ions.

The present invention will next be described specifically by the following examples.

EXAMPLE 1

Figure 3:
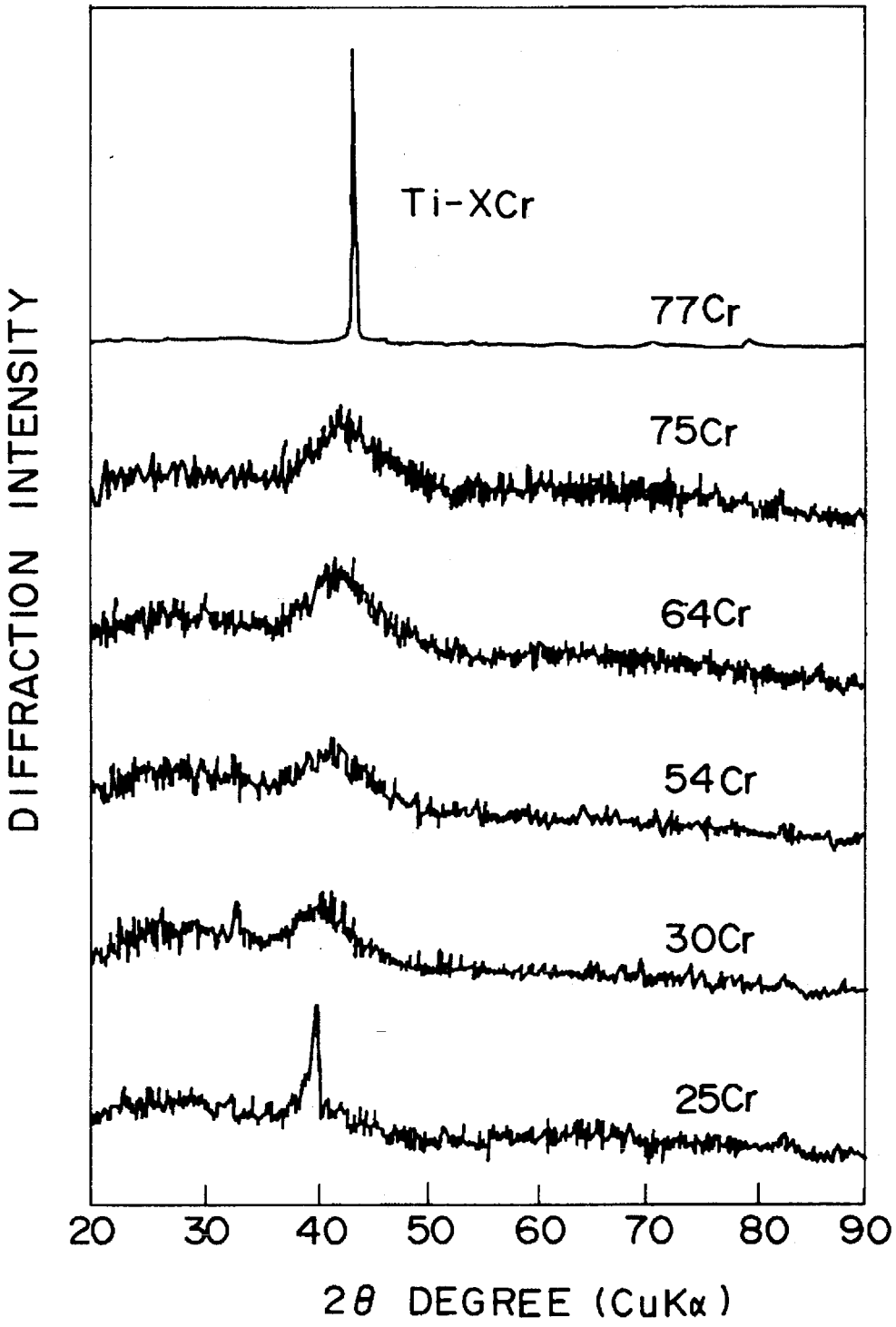
FIG. 3 is a diagrammatic representation showing the results of an X-ray diffraction analysis.

In each run, employed as a target was a Ti disk having a diameter of 100 mm and a thickness of 6 mm and carrying thereon 3 to 9 pieces of Cr pieces of 20 mm in diameter and 1 mm in thickness chosen in a desired combination and placed on and along a circle having a radius of 29 mm from the center of the Ti disk. Using the apparatus shown in FIG. 1, sputtering deposition was conducted at an output of 560 to 200 W on a glass substrate rotating about the axis 7 and revolving about the central shaft 1 while maintaining the sputtering chamber of the apparatus at a vacuum level of $2\times10^{-4}$ Torr and feeding Ar at a velocity of 5 ml/min. The compositions of alloys obtained as described above were analyzed by an X-ray microanalyzer. The results of X-ray analysis of those alloys are shown in FIG. 3. A sharp peak due to crystals is observed when the content of Cr is 25 atomic % or 77 atomic %. Halo patterns inherent to amorphous structures are observed in the range of 30 to 75 atomic %, thereby demonstrating the formation of the amorphous structures.

EXAMPLE 2

Figure 4:
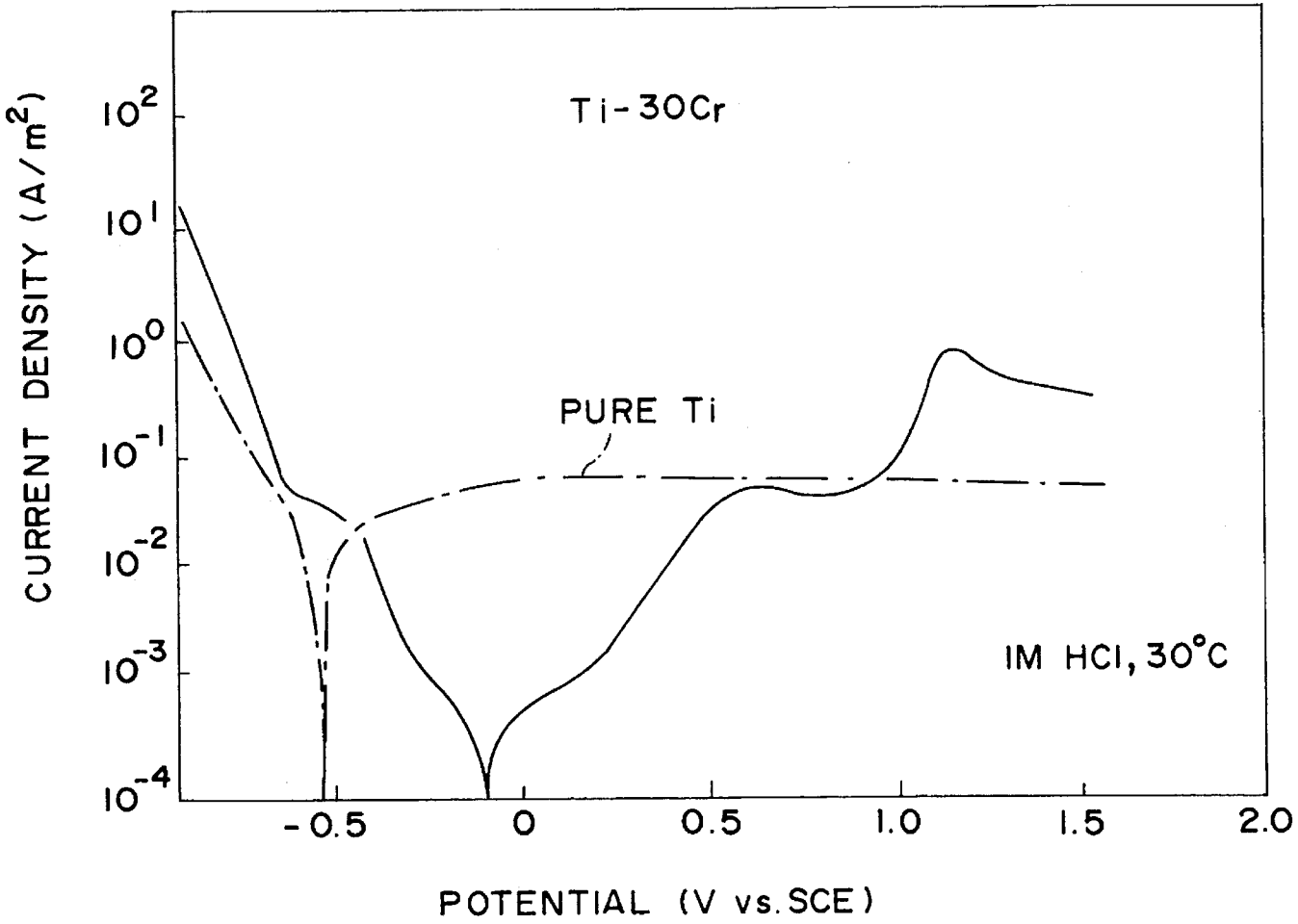
FIG. 4 is a diagrammatic representation showing the polarization curves of amorphous alloys and metal titanium.

Employed as a target was a Ti disk having a diameter of 100 mm and a thickness of 6 mm and carrying thereon four Cr pieces of 20 mm in diameter and 1 mm in thickness placed on and along a circle having a radius of 29 mm from the center of the Ti disk. The target was mounted on the apparatus shown in FIG. 1. While maintaining the sputtering chamber of the apparatus at a vacuum level of $2\times10^{-4}$ Torr and feeding Ar at a velocity of 5 ml/min, sputtering deposition was conducted at an output of 440 W on a glass substrate rotating about the axis 7 and revolving about the central shaft 1. An analysis by an X-ray microanalyzer confirmed that the composition of the resultant alloy was Ti-30 atomic % Cr. As a result of an X-ray diffraction analysis, the alloy was found to be amorphous as shown in FIG. 3. In FIG. 4, a polarization curve of the amorphous alloy in a 1M HCl solution at 30° C. is illustrated together with that of metal Ti. Although the open circuit potential of metal Ti was as low as about −0.5 V, the open circuit potential of the amorphous Ti-30 atomic % Cr alloy was as high as about −0.15 V. Moreover, the passive current density was significantly lower than that of metal Ti in the potential range of up to about +0.5 V. It is hence understood that the corrosion resistance has been improved.

EXAMPLE 3

Figure 5:
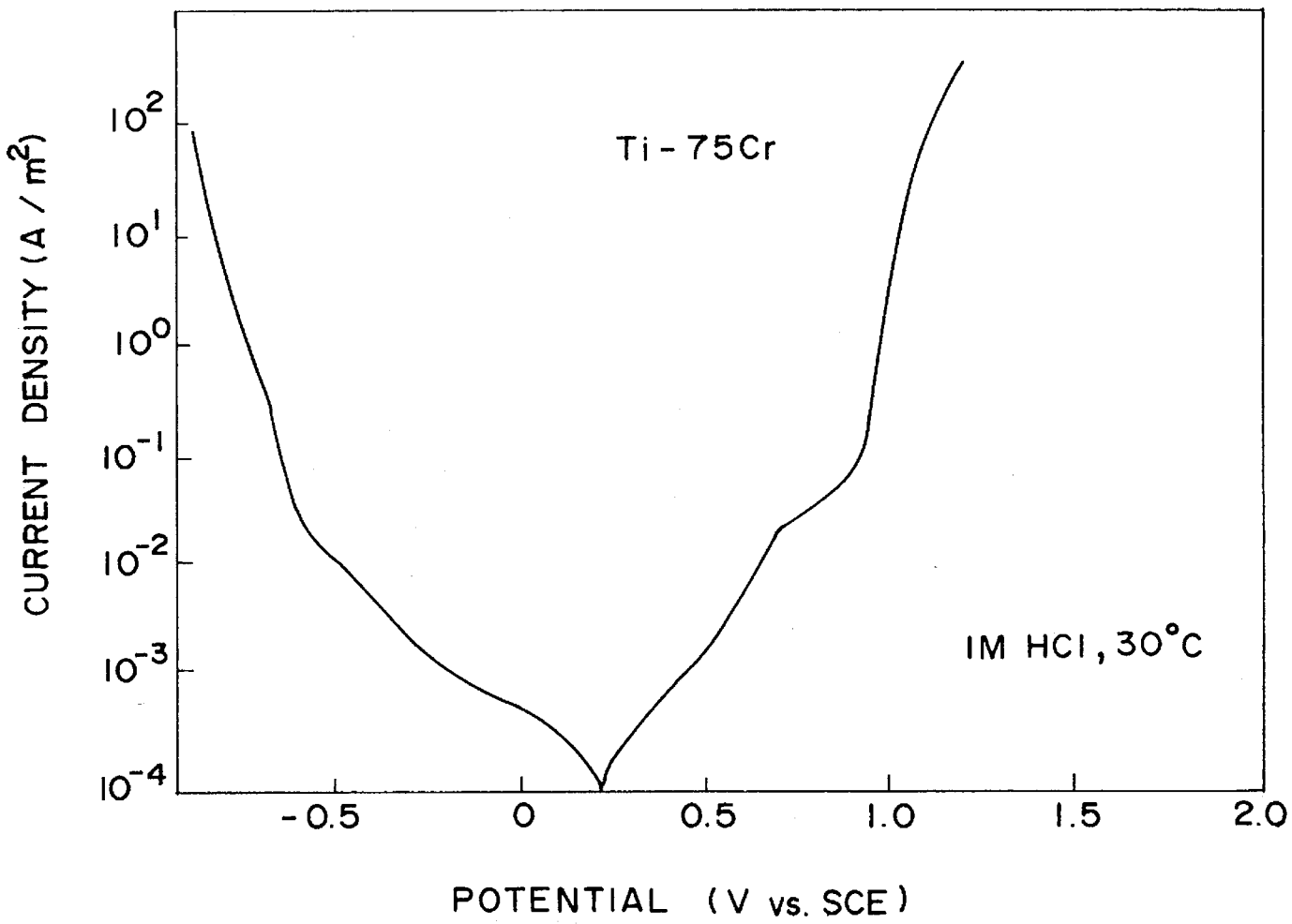
FIG. 5 is a diagrammatic representation depicting the polarization curve of amorphous Ti-75Cr.

Employed as a target was a Ti disk having a diameter of 100 mm and a thickness of 6 mm and carrying thereon eight Cr pieces of 20 mm in diameter and 1 mm in thickness placed on and along a circle having a radius of 29 mm from the center of the Ti disk. The target was mounted on the apparatus shown in FIG. 1. While maintaining the sputtering chamber of the apparatus at a vacuum level of $2\times10^{-4}$ Torr and feeding Ar at a velocity of 5 ml/min, sputtering deposition was conducted at an output of 480 W on a glass substrate rotating about the axis 7 and revolving about the central shaft 1. An analysis by an X-ray microanalyzer confirmed that the composition of the resultant alloy was Ti-75 atomic % Cr. As a result of an X-ray diffraction analysis, the alloy was found to be amorphous as shown in FIG. 3. A polarization curve of the amorphous alloy in a 1M HCl solution at 30° C. is illustrated in FIG. 5. The amorphous Ti-75 atomic % Cr alloy had been spontaneously passive and its open circuit potential was +0.18 V, i.e., still higher than that of the amorphous Ti-30 atomic % Cr alloy shown in FIG. 4. The passive current density near the open circuit potential was $10^{-4}$ A/m$^2$ i.e., extremely low. The amorphous Ti-75 atomic % Cr alloy has hence been found to shown excellent corrosion resistance.

EXAMPLE 4

Figure 6:
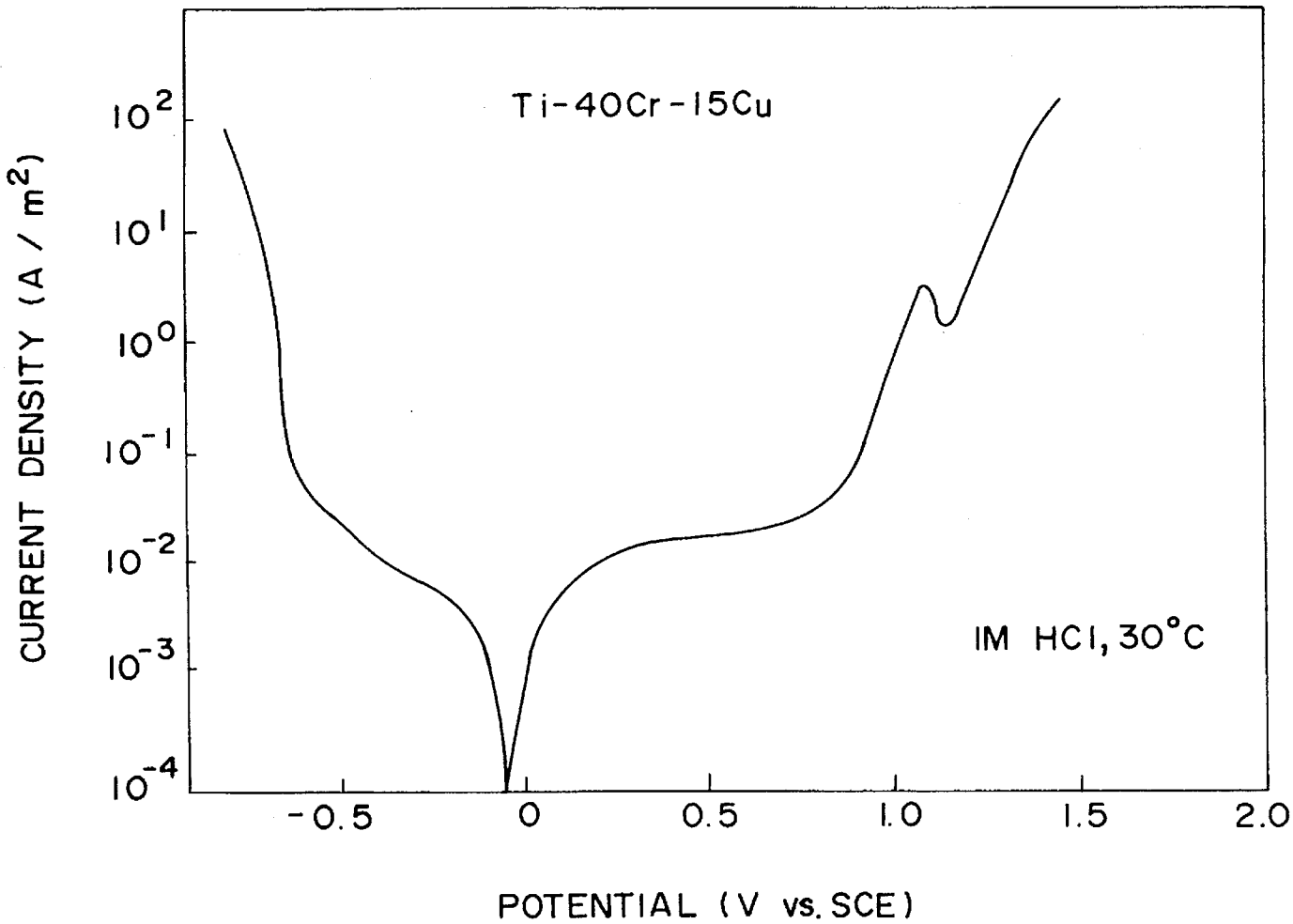
FIG. 6 is a diagrammatic representation showing the polarization curve of amorphous Ti-40Cr-15Cu.

Employed as a target was a Ti disk having a diameter of 100 mm and a thickness of 6 mm and carrying thereon five Cr pieces of 20 mm in diameter and 1 mm in thickness and two Cu pieces of 20 mm in diameter and 1 mm in thickness, all placed on and along a circle having a radius of 29 mm from the center of the Ti disk. The target was mounted on the apparatus shown in FIG. 1. While maintaining the sputtering chamber of the apparatus at a vacuum level of $2\times10^{-4}$ Torr and feeding Ar at a velocity of 5 ml/min, sputtering deposition was conducted at an output of 520 W on a glass substrate rotating about the axis 7 and revolving about the central shaft 1. As a result of an X-ray diffraction analysis, the resulting alloy was found to be amorphous. An analysis by an X-ray microanalyzer confirmed that the composition of the alloy was Ti-40 atomic % Cr-15 atomic % Cu. A polarization curve of the amorphous alloy in a 1M HCl solution at 30° C. is illustrated in FIG. 6. The amorphous Ti-40 atomic % Cr-15 atomic % Cu alloy had been spontaneously passive and its open circuit potential was about −0.1 V, which was higher by as much as 0.4 V than that of metal Ti shown in FIG. 3. The amorphous Ti-40 atomic % Cr-15 atomic % Cu alloy has hence been found to show excellent corrosion resistance.

EXAMPLE 5

A variety of targets with a third element embedded therein were employed, led by a target made of a Ti disk having a diameter of 100 mm and a thickness of 6 mm and containing therein four Cr pieces of 20 mm in diameter and 1 mm in thickness and two Zr pieces of 20 mm in diameter and 1 mm in thickness, all embedded on and along a circle having a radius of 29 mm from the center of the Ti disk. The targets were mounted on the apparatus shown in FIG. 2. While maintaining the sputtering chamber of the apparatus at a vacuum level of $2\times10^{-4}$ Torr and feeding Ar at a velocity of 5 ml/min, sputtering deposition was conducted on a glass substrate rotating about the axis 7 and revolving about the central shaft 1, by varying the outputs of the individual targets. As a result of an X-ray diffraction analysis, the resulting alloy was found to be amorphous. The compositional analysis of the alloys by an X-ray microanalyzer are summarized in Table 1. Those alloys were spontaneously passive in a 1M HCl solution at 30° C. and their open circuit potentials were as shown in Table 1. They have hence been found to be highly corrosion-resistant amorphous alloys.

Table 1 also shows measurement results of metal Ti as a comparative sample as well as measurement results of the amorphous alloys described in Examples 1–4.

TABLE 1

Comparison in open circuit potential in 1M HCl solution at 30° C.

| Alloy (Numeral indicates atomic %) | Open circuit potential (V vs. SCE) |
|---|---|
| Metal Ti (Comparative Sample) | −0.52 |
| Ti—30Cr | −0.15 |
| Ti—54Cr | +0.03 |
| Ti—64Cr | +0.35 |
| Ti—75Cr | +0.18 |
| Ti—35Zr—30Cr | −0.08 |
| Ti—51Zr—32Cr | +0.02 |
| Ti—22Zr—53Cr | +0.11 |
| Ti—18Zr—75Cr | +0.28 |
| Zr—20Cr—17Mg | −0.45 |
| Zr—60Cr—8Mg | +0.22 |
| Zr—32Cr—15Mo | +0.05 |
| Zr—22Cr—11W | −0.10 |
| Zr—30Cr—5Al | −0.38 |
| Ti—45Cr—20Cu | −0.02 |
| Ti—65Cr—14Fe | −0.21 |
| Ti—50Cr—6Co | −0.05 |
| Ti—20Cr—18Ni | −0.16 |
| Ti—75Cr—4Al | −0.33 |
| Ti—12Zr—20Cr—4Mg | −0.50 |
| Ti—30Zr—42Cr—8Al | −0.38 |
| Zr—15Ti—30Cr—20Fe | +0.11 |
| Zr—26Ti—20Cr—6Ni | −0.16 |
| Zr—8Ti—60Cr—12Cu | +0.28 |
| Ti—20Cr—7Fe—11Al | −0.50 |
| Ti—65Cr—4Ni—8Cu | +0.35 |
| Ti—15Zr—30Cr—3Mg—5Mo | −0.22 |
| Ti—8Zr—20Cr—11Co—9W | −0.34 |

As has been described in detail, amorphous alloys according to the present invention are alloys each of which is produced using a sputtering technique and consists of a combination of elements excellent in corrosion resistance (Ti and/or Zr, and Cr). These amorphous alloys have high corrosion resistance such that they form a stable protective film and are spontaneously passive even in various corrosive environments such as poorly oxidizing and highly corrosive HCl solutions and solutions containing chlorine ions.

What is claimed:

1. A method for producing a highly corrosion resistant single-phase amorphous alloy containing Cr and Ti comprising the steps of conducting sputtering while rotating one or more substrates about a central shaft and independently rotating the one or more substrates about their own axis to effect uniform sputtering deposition and utilizing a sputtering target having a composition represented by the following formula:

$$X_aCr_bM_c$$

wherein X is Ti; M is at least one element selected from the group consisting of Mg, Al, Co, Ni, Cu, Mo and W; and a, b and c are atomic percentages satisfying the following relationships:

$$a>20,$$

$$20\leqq b\leqq 75,$$

$$0\leqq c\leqq 20, \text{ and}$$

$$a+b+c=100,$$

to produce a chemically uniform single-phase amorphous alloy having a high corrosion resistance.

2. A method according to claim 1, wherein the sputtering target is made of a Ti plate having Cr placed thereon or embedded therein.

3. A method according to claim 1, wherein $25\leqq a\leqq 70$ and $\leqq 30\leqq b\leqq 75$.

4. A method according to claim 1, wherein the sputtering target is made of a Ti plate having Cr and at least one element selected from the group consisting of Mg, Al, Co, Ni, Cu, Mo and W placed thereon or embedded therein.

5. A method for producing a highly corrosion resistant single-phase amorphous alloy containing Cr and Zr comprising the steps of conducting sputtering while rotating one or more substrates about a central shaft and independently rotating the one or more substrates about their own axis to effect uniform sputtering deposition and utilizing a sputtering target having a composition represented by the following formula:

$$X_aCr_bM_c$$

wherein X is Zr; M is at least one element selected from the group consisting of Mg, Al, Fe, Co, Ni, Cu, Mo and W; and a, b and c are atomic percentages satisfying the following relationships:

$$a>20,$$

$$20\leqq b\leqq 75,$$

$$0\leqq c\leqq 20, \text{ and}$$

$$a+b+c=100,$$

to produce a chemically uniform single-phase amorphous alloy having a high corrosion resistance.

6. A method according to claim 5, wherein the sputtering target is made of a Zr plate having Cr placed thereon or embedded therein.

7. A method according to claim 5, wherein $25\leqq a\leqq 70$ and $30\leqq b\leqq 75$.

8. A method according to claim 5, wherein the sputtering target is made of a Zr plate having Cr and at least one element selected from the group consisting of Mg, Al, Fe, Co, Ni, Cu, Mo and W placed thereon or embedded therein.

9. A method for producing a highly corrosion resistant single-phase amorphous alloy containing Cr, Ti and Zr comprising the steps of conducting sputtering while rotating one or more substrates about a central shaft and independently rotating the one or more substrates about their own axis to effect uniform sputtering deposition and utilizing a sputtering target having a composition represented by the following formula:

$$X_aCr_bM_c$$

wherein X is Ti and Zr; M is at least one element selected from the group consisting of Mg, Al, Fe, Co, Ni, Cu, Mo and W; and a, b and c are atomic percentages satisfying the following relationships:

$a>20$, $20 \leqq b \leqq 75$, $0 \leqq c \leqq 20$, and $a+b+c=100$, to produce a chemically uniform single-phase amorphous alloy having a high corrosion resistance.

10. A method according to claim 9, wherein the sputtering target is made of a Ti plate having Cr and Zr placed thereon or embedded therein.

11. A method according to claim 9, wherein the sputtering target is made of a Ti plate or a Zr plate having Cr placed thereon or embedded therein.

12. A method according to claim 9 wherein $25 \leqq a \leqq 70$ and $30 \leqq b \leqq 75$.

13. A method according to claim 9, wherein the sputtering target is made of a Zr plate or a Ti plate having Cr and at least one element selected from the group consisting of Mg, Al, Fe, Co, Ni, Cu, Mo and W placed thereon or embedded therein.

* * * * *